US006398133B1

(12) United States Patent
Schultz

(10) Patent No.: US 6,398,133 B1
(45) **Date of Patent: *Jun. 4, 2002**

(54) DISPENSING HEAD FOR A SQUEEZE DISPENSER

(75) Inventor: Robert S. Schultz, Old Greenwich, CT (US)

(73) Assignee: EMSAR, Inc., Stratford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/470,892

(22) Filed: Dec. 22, 1999

(51) Int. Cl.[7] ..... B65D 1/32

(52) U.S. Cl. ..... 239/327; 239/311; 239/106; 239/340; 239/403; 239/209; 239/402.18

(58) Field of Search ..... 239/106, 117, 239/265.17, 265.43, 270, 295, 315–316, 369, 371–372, 397, 413, 416.4, 417.3, 419.5, 424, 424.5, 425.5, 438, 441, 443, 455, 471, 504–506, 571–574, 327, 403, 434, 340, 399, 341, 345–348, 300, 290, 311, 314, 318, 337; 222/209, 402.18, 570, 525, 482

(56) References Cited

U.S. PATENT DOCUMENTS

| | | | |
|---|---|---|---|
| 368,345 A | 8/1887 | Leith | |
| 1,639,059 A | 8/1927 | Saloun | |

(List continued on next page.)

FOREIGN PATENT DOCUMENTS

| | | | |
|---|---|---|---|
| EP | 0 125 970 A1 | 11/1984 | ..... B65D/83/14 |
| GB | 000010176 A | 5/1901 | |
| GB | 000992750 A | 5/1965 | ..... 460/150 |
| GB | 0001085445 | 10/1967 | ..... 310/222 |
| IT | 000685346 B | 3/1965 | ..... 310/215 |
| WO | WO 8606701 | 11/1986 | ..... B65D/6/30 |

*Primary Examiner*—Henry C. Yuen
*Assistant Examiner*—Christopher S. Kim
(74) *Attorney, Agent, or Firm*—Kenyon & Kenyon

(57) ABSTRACT

A spray dispensing head for a squeeze dispenser is disclosed. The dispensing head includes passageways for directing streams of air and liquid to a mixing chamber wherein the liquid is broken up into droplets and emitted as a fine spray through an orifice. The device includes a valve which is operated by a push-pull motion. When the valve is closed, the liquid is sealed off from the atmosphere, thus preventing drying or contamination of the liquid product.

11 Claims, 4 Drawing Sheets

U.S. PATENT DOCUMENTS

| | | | | | |
|---|---|---|---|---|---|
| 1,716,525 | A | | 6/1929 | Leong | |
| 2,125,788 | A | | 8/1938 | Johnson | 215/7 |
| 2,731,053 | A | | 1/1956 | Lockhart | 150/0.5 |
| 2,823,249 | A | | 2/1958 | Curtiss | 174/87 |
| 2,823,836 | A | | 2/1958 | Bach | 222/51 |
| 2,879,924 | A | | 3/1959 | Bacheller | 222/207 |
| 2,961,169 | A | | 11/1960 | Nyden | 239/327 |
| 3,090,529 | A | | 5/1963 | Lipman | 222/209 |
| 3,255,934 | A | | 6/1966 | Leonard | 222/211 |
| 3,355,072 | A | | 11/1967 | Sheppard et al. | 222/211 |
| 3,371,825 | A | * | 3/1968 | Cullen | 239/337 |
| 3,401,845 | A | | 9/1968 | Bach | 222/211 |
| 3,856,170 | A | | 12/1974 | Kessler | 215/224 |
| 4,162,749 | A | | 7/1979 | Bennett | |
| 4,211,346 | A | | 7/1980 | Mehra et al. | 222/205 |
| 4,223,842 | A | * | 9/1980 | Hayes | 239/327 |
| 4,228,931 | A | | 10/1980 | Ruscitti et al. | 222/321 |
| 4,350,298 | A | * | 9/1982 | Tada | 239/333 |
| 4,401,270 | A | | 8/1983 | McKinney | 239/327 |
| 4,530,466 | A | | 7/1985 | Rounkles et al. | 239/327 |
| 4,711,378 | A | | 12/1987 | Anderson | 222/499 |
| 4,773,553 | A | | 9/1988 | Van Brocklin | |
| 4,773,570 | A | | 9/1988 | Workum | 222/189 |
| 4,798,311 | A | | 1/1989 | Workum | 222/131 |
| 4,878,604 | A | | 11/1989 | Barriac | 222/209 |
| 4,898,307 | A | | 2/1990 | Tiramani | 222/207 |
| 4,979,648 | A | * | 12/1990 | Montgomery et al. | 222/153 |
| 5,115,949 | A | | 5/1992 | Rosenthal | 222/211 |
| 5,183,186 | A | | 2/1993 | Delaney, Jr. | 222/211 |
| 5,273,191 | A | * | 12/1993 | Meshberg | 222/105 |
| 5,318,205 | A | | 6/1994 | Delaney, Jr. | 222/211 |
| 5,328,061 | A | | 7/1994 | Libit et al. | 222/212 |
| 5,390,828 | A | | 2/1995 | Gross | 222/211 |
| 5,562,219 | A | | 10/1996 | de Pous et al. | 215/274 |
| 5,593,064 | A | | 1/1997 | Meshberg | 222/39 |
| 5,620,113 | A | | 4/1997 | Meshberg | 222/1 |
| 5,622,317 | A | * | 4/1997 | Foster et al. | 239/333 |
| 5,667,104 | A | | 9/1997 | Meshberg | 222/143 |
| 5,875,918 | A | | 3/1999 | Scheffler et al. | 220/783 |
| 5,875,932 | A | | 3/1999 | Meshberg | 222/153.13 |
| 6,050,504 | A | * | 4/2000 | Schultz et al. | 239/327 |

* cited by examiner

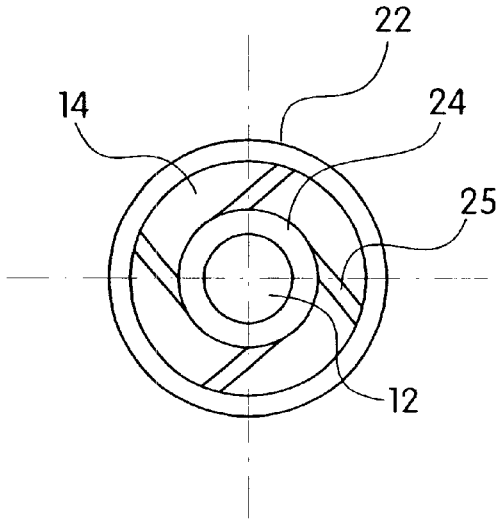
FIG. 3
FIG. 4C
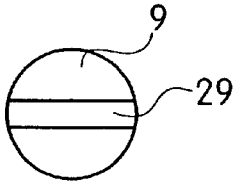
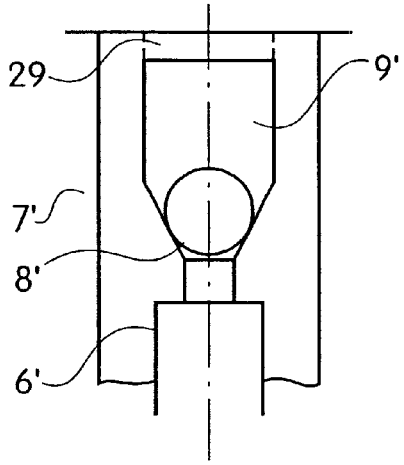
FIG. 4A
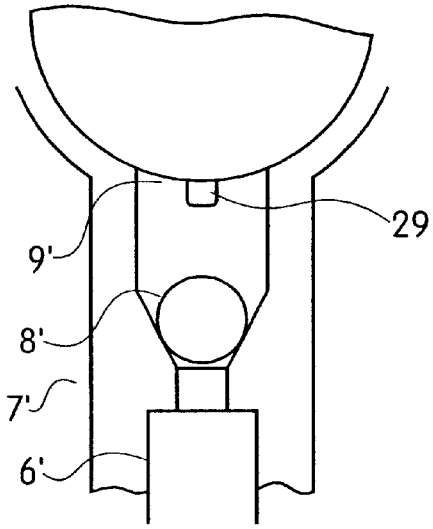
FIG. 4B

DISPENSING HEAD FOR A SQUEEZE DISPENSER

FIELD OF THE INVENTION

This invention relates to a dispensing head for a dispenser which is pressurized by squeezing the sides of the container. More particularly, the invention is directed to a dispensing head in which air and liquid are mixed to produce a fine spray, and in which there is a push-pull type valve arrangement for sealing off the dispensed liquid from the atmosphere when the dispenser is not in use.

BACKGROUND OF THE INVENTION

Although squeeze bottle type sprayers have been used for many years, such sprayers were largely replaced for a long period of time by pressurized can dispensing systems. One squeeze bottle dispenser which has come into use as a substitute for pressurized cans is described in U.S. Pat. Nos. 5,183,186 and 5,318,205. These patents show a squeeze bottle dispenser in which an air passageway and a product (i.e., fluent material) passageway meet in a tapered mixing chamber. In the device of that invention, the tapering of the mixing chamber direct the air flow at an angle to the flow of liquid, resulting in turbulence in the liquid in the mixing chamber. This turbulence breaks the liquid up and intimately mixes it with the air. As a result, a fine spray is propelled out of the orifice.

The disadvantage of this invention is that it requires the use of a relatively expensive ball valve for the liquid outlet, and liquid will leak out of the dispenser when the bottle is inverted, because the air path is completely open to fluid flow. Furthermore, in this arrangement, the outlet orifice and the air vent path allow air to be in continuous contact with the liquid to be dispensed. This can result in drying of the liquid substance—disadvantageous result which can clog the outlet orifice and prevent proper spraying.

Another patent relating to squeeze bottles is U.S. Pat. No. 5,273,191. That patent also describes a squeeze bottle using a tapered mixing chamber for mixing air and liquid. In that patent, various valving arrangements are shown, including valved gaskets for controlling the flow of liquid to the mixing chamber and for controlling the flow of air to the mixing chamber and into the squeeze bottle. In addition, that patent shows a biased valve element which opens and closes the liquid passage in response to the pressure in the liquid passage.

A dispensing head for a dispenser with a push-pull type valve arrangement is disclosed in U.S. patent application Ser. No. 09/073,615, now U.S. Pat. No. 6,050,504 which is incorporated by reference. In that invention, a squeeze bottle has a liquid flow path and an air flow path. When the bottle is squeezed, liquid is transmitted through the liquid flow path and pressurized air through the air flow path. These two flows meet in a mixing chamber which is located adjacent to an outlet orifice. The air and liquid mix to form a fine spray. The disadvantage of this invention is that the pull knob is located opposite the outlet orifice. Furthermore, this invention allows air to be in continuous contact with the liquid to be dispensed.

SUMMARY OF THE INVENTION

It is an object of the invention to provide a spray dispensing device for use with a non-pressurized container, such as a squeeze bottle, which utilizes a push-pull type valve, with the pull knob located on the same side as the outlet orifice.

It is a further object of the invention to provide a valve which prevents the infiltration of air into the internal passages of the dispenser.

In accordance with the invention, a spray dispenser is provided having a dip tube which can extend into a container, such as a squeeze bottle, holding a quantity of liquid. The top of the dip tube is connected to a ball-check valve assembly having a ball which ordinarily rests on top of a conduit of restricted diameters. An air passage in the spray dispenser can connect the inside of the bottle with a mixing chamber in the dispenser. A separate product passage leads from the top of the ball-check to a mixing chamber and is directed toward a spray orifice in the mixing chamber. The air passage is an annular passageway which is concentrically disposed around a portion of the product passage leading to the mixing chamber.

When the bottle is squeezed, the resulting pressure build up forces air into the mixing chamber and liquid up the dip tube. The liquid forces the ballcheck to open and the liquid is directed toward the mixing chamber. Simultaneously, air is forced through the annular air passage. The stream of air converges and impinges upon the core stream of liquid when deflected by tapered walls of the mixing chamber. This causes an atomization of the liquid and a fine spray is expelled through the orifice.

As the pressure in the bottle is relieved, the ball drops down back onto the conduit of restricted diameter thereby trapping product in the dip tube. Thus, the product will be retained in the dip tube at a high level, above the liquid level in the bottle, ready for the next squeeze cycle. In this way, the lag time which ordinarily occurs prior to spraying is eliminated.

The product passage is formed in a valve which is housed in a body of the spray dispenser. The valve may advantageously be formed as a push-pull valve which opens and closes the air and product passageways. In a closed position of the valve, both the product and air passageway are completely closed to the inside of the squeeze bottle, thereby preventing air from entering the inside of the squeeze bottle. The closing off of the passageways therefore reduces potential drying of the liquid product in the squeeze bottle.

It is a further advantage of the push-pull valve of the present invention that it may be operated by a knob located on the same side as the outlet orifice. Consumers are particularly familiar with valves that operate in such a manner from such product dispensers as liquid dish detergent bottles.

It is a further object of this invention to provide an improved snap on connection for fastening the spray housing to a neck of a bottle. In accordance with this object, the spray housing is provided with a flexible skirt which extends into an annular groove on the bottle. The annular groove exerts a radial force on the flexible skirt, which provides additional locking power for the snap on connection.

Advantageously, this allows the skirt wall to be made of thinner material, yet still provide sufficient locking power. Since the skirt wall can be made of thinner material, the neck can be manufactured with larger tolerances and the spray housing can still be mounted over the neck without requiring excessive force to push the dispenser housing over the neck. The larger tolerances allow the bottles to be made in various production plants worldwide. Furthermore, because the skirt is combined within the annular groove, the bottle/spray dispenser combination is more tamper resistant than traditional designs.

Further objectives and advantages of the subject invention will be apparent to those skilled in the art from the detailed description of the disclosed invention.

BRIEF DESCRIPTION OF THE DRAWINGS

FIG. 3 is a cross-sectional view through line AA in FIG. 1, of the valve.

FIGS. 4A, 4B and 4C show an alternative ball check valve. FIG. 4A is a front view, FIG. 4B is a side view, and FIG. 4C is a top view.

DETAILED DESCRIPTION OF PREFERRED EMBODIMENTS

Figure 1:
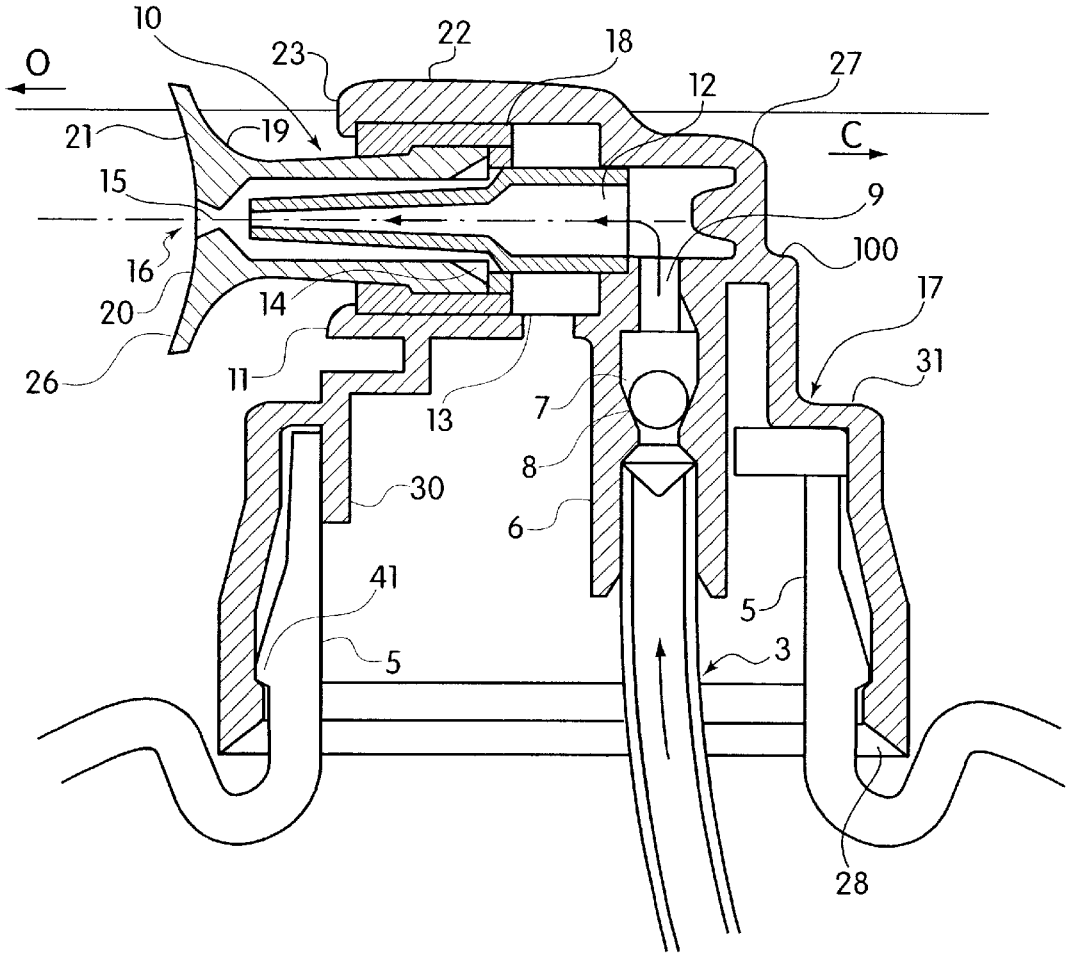
FIG. 1 is a cross-sectional view of the push-pull spray head, illustrating the valve in a fully open position.

As shown in FIG. 1, the spray dispensing system of the present invention includes a squeezable bottle 1 (partially shown) holding a quantity of liquid or other fluent material. Squeezable bottle can be made from any suitable resilient plastic material known in the art.

A spray dispensing device housing or sprayer body 17 is adapted to be mountable atop a neck 5 of a bottle 1 in any manner known to those skilled in the art. The spray dispensing device housing 17 includes a dip tube 3 which is sized so that its bottom open end is disposed near the bottom of the bottle when the spray dispensing device is mounted on the bottle.

The top end of dip tube 3 receives a restricted conduit 6 of a ballcheck valve 7. Restricted conduit 6 communicates with dip tube 3 so as to allow fluid to pass through. The inner diameter of restricted conduit 6 is smaller than the diameter of ball 8 of ballcheck valve 7 so that ball 8 ordinarily sits atop restricted conduit 6. When ball 8 is in this position, the ballcheck valve 7 is closed so that the top end of dip tube 3 is also closed. The inner diameter of the remainder of ballcheck valve 7 is larger than the diameter of ball 8. In this way ball 8 is free to move upward in response to upward movement of fluid in the dip tube to open ballcheck valve 7.

The top of ballcheck valve 7 receives a coaxially disposed feed tube 9 which allows for the passage of fluid from restricted conduit 6 toward valve 10. Feed tube 9 has an inner diameter which is smaller than the diameter of ball 8 so as to limit the movement of ball Bin an upward direction. The end of feed tube 9 includes a series of circumferentially spaced radial slots 100. Slots 100 allow the free flow of fluid through ballcheck valve 7 to the feed tube 9 when the ball 8 moves upwardly in response to the upward movement of fluid. Therefore, feed tube 9 is positioned a small distance upward from ball 8 so that ball 8 is free to move upward to open ballcheck valve 7.

FIGS. 4A and 4B show an alternative construction of the ball check valve. In this construction, the inner diameter of the feed tube 9' is substantially the same as the remainder of ballcheck valve 7'. A bar 29 is formed across the top of feed tube 9'. Ball 8' is therefore free to move upward to open the ballcheck valve 7', but the movement is limited. Because the diameter of the feed tube is larger than the diameter of ball 8, product may flow freely past the ball.

Returning to FIG. 1, for simplicity of construction feed tube 9 is an extension of a valve wall 11 of housing 17. Feed tube 9 of valve wall 11 can communicate with a product passageway 12 within valve 10 when valve 10 is in an open position. Valve wall 11 is also provided with an air orifice 13 which communicates with an annular air passageway 14. As illustrated in FIG. 1, the annular air passageway 14 is defined as the space between the body of slide housing 22 and the spray nozzle 21 so that it is concentrically disposed around the portion of the product passageway 12 which leads to the air swirl passages 15 in an axial horizontal direction. Valve 10 is slidably received in the cavity between valve walls 11 and 18 of spray dispenser housing 17.

Valve 10 is constructed from two pieces, spray nozzle 21 and slide housing 22. Spray nozzle 21 is secured, preferably using a snap connection, in slide housing 22. Spray nozzle 21 includes a pull knob 26 which is grasped by the user to push and pull the slide valve 10 in the opening direction O and the closing direction C.

Figure 2:
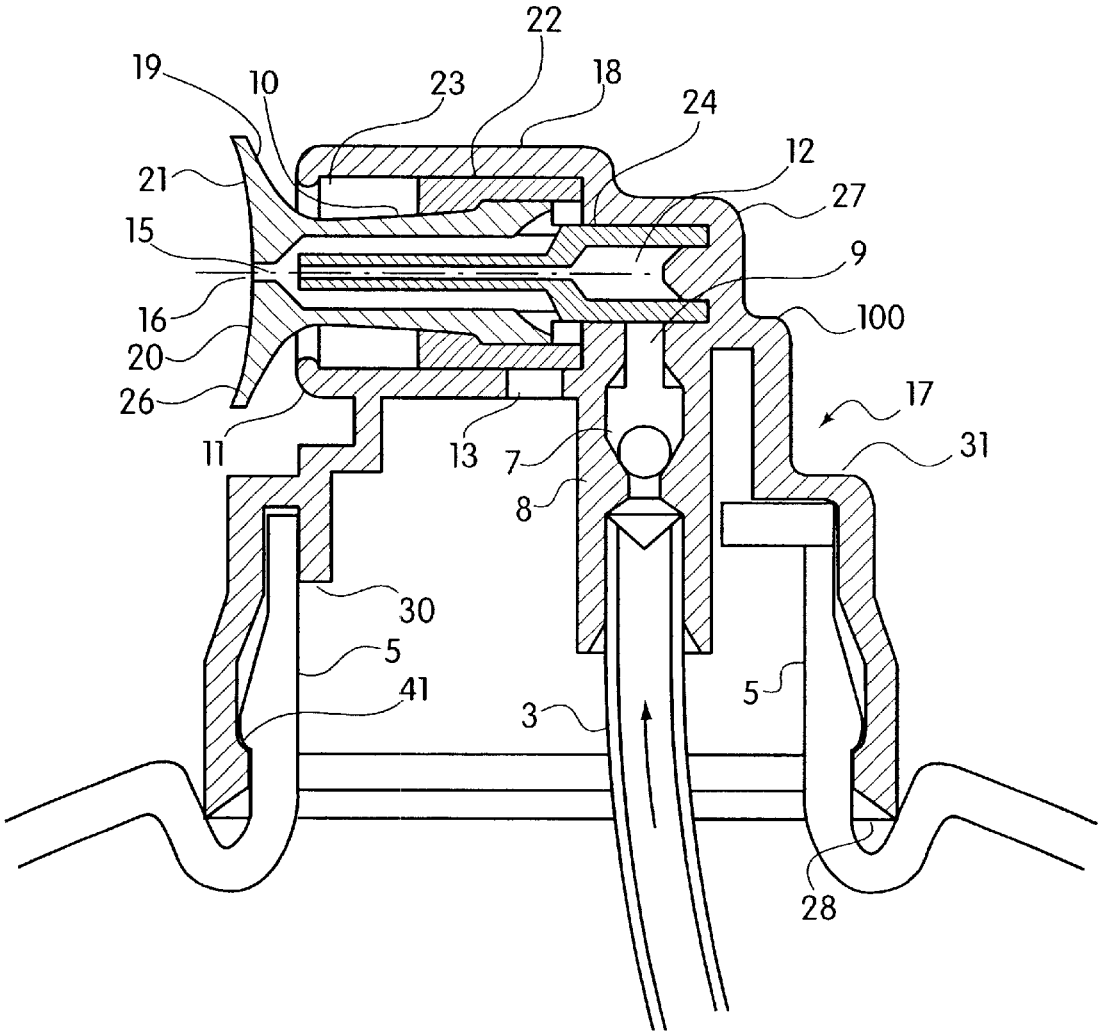
FIG. 2 is a cross-sectional view of the push-pull spray head, illustrating the valve in a fully closed position.

Tapered portions 19 and 20 of spray nozzle 21 define a cavity therebetween which shall be referred to as a mixing chamber 15. The tapered portions 19 and 20 may define a cone. A portion of the product passageway 12 leads to mixing chamber 15 in a generally horizontal direction. As illustrated in FIGS. 1 and 2, the annular air passageway 14 is concentrically disposed around the portion of the product passageway 12 which leads to the mixing chamber 15 in a horizontal direction. Tapered portions 19 and 20 terminate before meeting to define spray orifice 16 of mixing chamber 15.

The neck 5 on the bottle 1 has an annular ledge 41, and cooperates with the annular rim 28 on the spray dispenser housing 17 to secure housing 17 to bottle 1 when the housing is pressed onto the neck of bottle 1. The housing may be sealed to the bottle by either a plug seal 30 or a gasket arrangement 31, as known to those skilled in the art.

Figure 5:
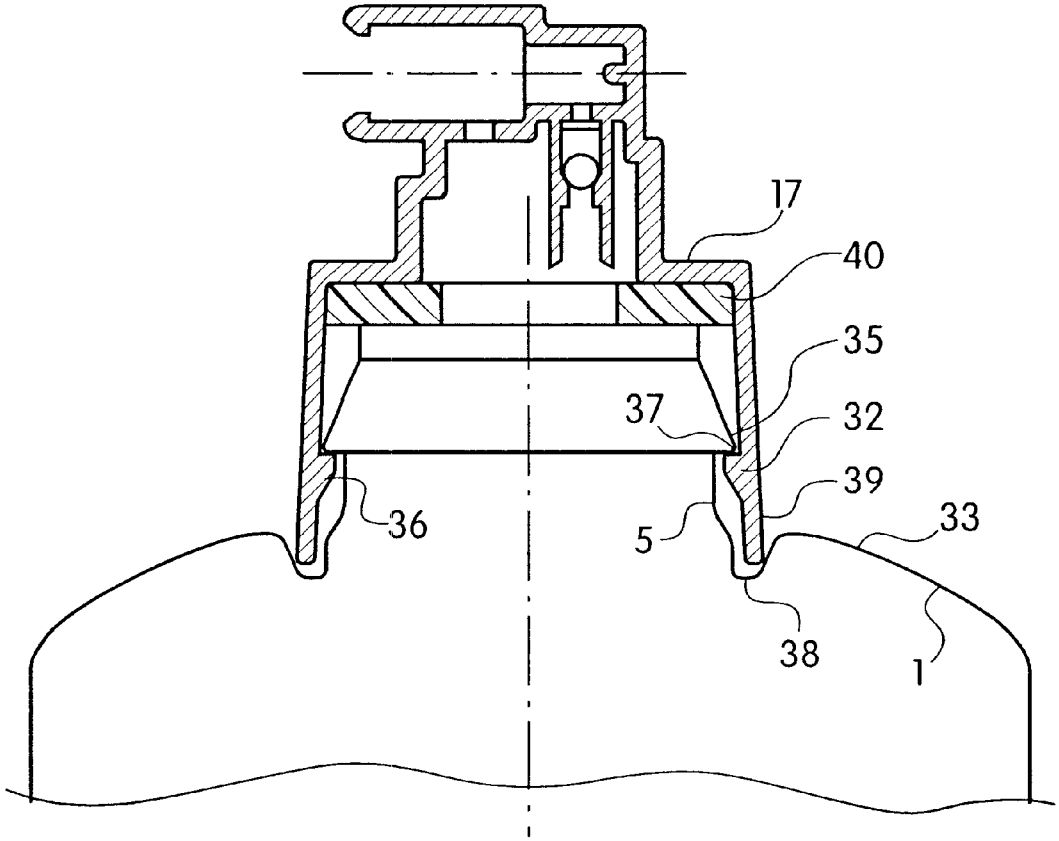
FIG. 5 is a cross sectional view of a spray housing retaining means.

Alternatively, the cap may be mounted to the bottle in the manner shown in FIG. 5. In FIG. 5., the spray housing 17 has a first annular rim 32 with a first locking edge 37. The bottle 33 has a neck 34. The neck has a second annular rim 35 with a second locking ledge 36. The first locking ledge 37 cooperates with the second locking ledge 36 to fasten the spray housing onto the bottle. There is an annular groove 38 at the connection between the neck 5 and the bottle 1. The skirt 39 of the spray housing extends into this groove. There is a gasket 40 between the housing and the rim of the neck to provide a substantially fluid tight seal. Alternatively a plug seal may be utilized to form the fluid tight seal. To mount the spray housing on the bottle, the spray housing 17 is pressed over the neck of the bottle. The skirt 39 elastically flexes to allow the first annular rim 32 to pass over the second annular rim 35. After the first annular passes over the second annular rim, the elasticity of the skirt forces the second annular rim back toward the neck. The first and second locking edges are then positioned together and prevent the cap from being removed. Additionally, the flexible skirt 39 extends into the groove 38, and the shape of the groove 38 holds the edges of the skirt in place to provide more holding power.

Returning to FIG. 1, slide housing 22 is housed within the cavity between valve walls 11 and 18 of housing 17. Slide housing 22 is slidable along its longitudinal axis between a completely open position (FIG. 1) and a completely closed position (FIG. 2). In the completely closed position, the product passageway 12 is not aligned with the feed tube 9, and air passageway 14 is not aligned with the air orifice 13. As illustrated in FIG. 2, in the completely closed position slide housing 22 completely seals off feed tube 9 and air orifice 13.

Slide housing 22 is slideably removed within valve walls 11 and 18 of housing 17. A rim 23 on housing 17 restrains the inward and outward movement of the slide housing. Slide housing 22 includes a stem portion 24. Stem portion 24 is integrally molded with the slide housing 22 via radial ribs 25 which created passages for air to flow between slide housing and the radial ribs 25. As shown in FIG. 3, radial ribs 25 are preferably at a 45° angle to allow for a resilient fit. Product passageway 12 passes through stem portion 24.

End wall 27 of housing 17 is adapted to receive stem portion 24. In a closed position, side wall 27 and plug seal 50 completely seal off product passageway 12.

The operation of the spray dispensing device of the invention as used with a squeeze bottle will now be explained by describing the path of fluid and air. Upon squeezing the bottle 1 the pressure inside the bottle increases urging fluid 2 up dip tube 3. Fluid is forced through restricted conduit 6 and pushes ball 8 upward off the top of conduit 6 thereby opening ballcheck valve 7. The fluid is then free to flow into feed tube 9 toward product passageway 12. From passageway 12 the fluid stream is injected into mixing chamber 15 in a horizontal direction toward the spray orifice 16. It can be seen from FIGS. 1 and 2 that the product passageway 12 communicates with the mixing chamber 15 at a location which is directly opposite the spray orifice.

Upon squeezing the bottle the increase in pressure also forces air above the fluid level in the bottle through air orifice 13 into the annular passageway 14. It can be seen that the distance which must be traveled by the air to reach the mixing chamber 15 is less than the distance which must be traveled by the liquid so that liquid does not reach the mixing chamber before the air. In this way, it is made certain that the fluid is mixed with air before emanating from orifice 16.

The annular air passageway 14 leads to the mixing chamber in a horizontal direction and communicates with the mixing chamber 15 at a location which is directly opposite the tapered or conical section 19, 20 of the mixing chamber. Tapered portions 19, 20 direct the annular air stream from passageway 14 at the acute angle to the central horizontal stream of liquid from passageway 12. Thus, the annular stream of air converges and impinges upon the core stream of liquid at a point in proximity to the spray orifice 16. The liquid is subjected to considerable turbulence which breaks it up and intimately mixes it with the air. The result is that a fine spray is propelled out of orifice 16 which exhibits a circular and symmetrical spray pattern wherein the droplets exhibit a symmetrical particle size distribution.

When pressure is released on the container it returns to its original shape as external air is drawn into the container through orifice 16. The drawing of air through orifice 16 cleans the orifice and the mixing chamber 15 after each squeeze cycle thereby inhibiting clogging of the orifice. This self-cleaning feature of the invention is particularly advantageous in the case of a viscous product where clogging is most frequently encountered.

The release of pressure also causes the liquid to drop down feed tube 9 which helps ball 8 to drop thereby closing the top of restricted conduit 6. It will be appreciated that the closing of the conduit 6 by ball 8 will trap liquid in feed tube 3. Thus, during the next squeeze cycle product will already be at a very high level in the dip tube so that less time will transpire before spray is emitted. In this way the present invention achieves nearly instantaneous spraying without the need for a pressurized container.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A dispensing head for a squeeze bottle sprayer comprising:

sprayer housing defining a cavity therein, with an air orifice and a liquid orifice being defined through said housing, the housing further defining a plug seal;

a valve contained within the cavity, the valve defining an air passageway, a liquid passageway defining a stem portion, a mixing chamber, and an outlet orifice, the valve being slidable along a longitudinal axis between an open position and a closed position, said longitudinal axis being generally aligned with the outlet orifice;

the plug seal configured to seal the stem portion of the liquid passageway and the stem portion configured to seal the liquid orifice when the valve is in the closed position;

the liquid passageway communicating with the mixing chamber and the liquid orifice in the open position of the valve;

the air passageway communicating with the mixing chamber and the air orifice in the open position of the valve; and wherein the mixing chamber is out of communication with the liquid orifice and the air orifice when the valve is in the closed position.

2. The dispensing head of claim 1, further comprising a pull knob located on the same side of the valve and the spray orifice.

3. The dispensing head of claim 2, further comprising means for retaining liquid in the dip tube at a level which is higher than a level of liquid in a container upon deactivation of the container.

4. The dispensing head according to claim 3, wherein the means for retaining liquid in the dip tube is a ball-check valve.

5. The dispensing head according to claim 4, wherein the ball-check valve has a feed tube which has substantially the same diameter throughout, and further comprising;

retaining rib positioned in the liquid orifice.

6. A squeeze bottle sprayer which is actuated upon squeezing the bottle to force liquid up a dip tube and emit a liquid-air spray through a spray orifice, comprising:

a squeezable bottle containing a volume of liquid and air above the liquid;

a dip tube extending into said volume of liquid;

a sprayer body having a plug seal, the sprayer body defining a valve receptacle therein, having a valve, a tapered section defining a mixing chamber therein, the tapered section being tapered in a direction toward a spray orifice which is defined through the valve at a terminal point of the tapered section; the valve defining a liquid passageway therethrough connecting the dip tube with the mixing chamber in an open position of the valve, the liquid passageway defining a stem portion, at least a portion of the liquid passageway being disposed in a direction toward the spray orifice and having a longitudinal axis aligned through said portion and said spray orifice, the valve and the liquid passageway being selectively slidable along said longitudinal axis to a closed position wherein the mixing chamber is disconnected from the dip tube;

an air passageway, concentrically disposed around said portion of the liquid passageway, the air passageway connecting an interior of the bottle containing said volume of air with the mixing chamber and the air passageway communicating the mixing chamber at a location directly opposite to the tapered section of the sprayer body; wherein the mixing chamber is disconnected from the interior of the bottle in a closed position of the valve; and a pull knob located on the same side of the valve as the spray orifice, whereby the plug seal is configured to seal the stem portion of the liquid passageway and the stem portion is configured to seal the dip tube when the valve is in the closed position; and whereby upon actuation of the squeeze bottle sprayer when the valve is in the open position, a stream of air from the air passageway will be deflected by the tapered section of the sprayer body to converge and impinge upon a core stream of liquid from the liquid passageway in the mixing chamber to atomize the stream of liquid.

7. The squeeze bottle sprayer according to claim 6 further comprising a ball-check valve in fluid communication with the dip tube and the liquid passageway, wherein the ball-check valve retains liquid in the dip tube at a level which is higher than a level of liquid in the bottle upon activation of the container.

8. A squeeze bottle sprayer which is actuated upon squeezing the bottle to force liquid up a dip tube and emit a liquid-air spray through a spray orifice, comprising:

a squeezable bottle containing a volume of liquid and air above the liquid;

a dip tube extending into said volume of liquid;

a sprayer body having a plug seal, the sprayer body defining a valve receptacle therein, having a valve, a tapered section defining a mixing chamber therein, the tapered section being tapered in a direction toward a spray orifice which is defined through the valve at a terminal point of the tapered section; the valve defining a liquid passageway therethrough connecting the dip tube with the mixing chamber in an open position of the valve, the liquid passageway defining a stem portion, at least a portion of the liquid passageway being disposed in a direction toward the spray orifice and having a longitudinal axis aligned through said portion and said spray orifice, the valve and the liquid passageway being selectively slidable along said longitudinal axis to a closed position wherein the mixing chamber is disconnected from the dip tube, said valve being constructed from two pieces;

an air passageway, concentrically disposed around said portion of the liquid passageway, the air passageway connecting an interior of the bottle containing said volume of air with the mixing chamber and the air passageway communicating the mixing chamber at a location directly opposite to the tapered section of the sprayer body; wherein the mixing chamber is disconnected from the interior of the bottle in a closed position of the valve; and a pull knob located on the same side of the valve as the spray orifice, whereby the plug seal is configured to seal the stem portion of the liquid passageway and the stem portion is configured to seal the dip tube when the valve is in the closed position; and whereby upon actuation of the squeeze bottle sprayer when the valve is in the open position, a stream of air from the air passageway will be deflected by the tapered section of the sprayer body to converge and impinge upon a core stream of liquid from the liquid passageway in the mixing chamber to atomize the stream of liquid.

9. A squeeze bottle sprayer which is actuated upon squeezing the bottle to force liquid up a dip tube and emit a liquid-air spray through a spray orifice, comprising:

a squeezable bottle containing a volume of liquid and air above the liquid, the bottle having a neck with a retaining rim;

a dip tube extending into said volume of liquid;

a sprayer body having a plug seal, the sprayer body defining a valve receptacle therein, having a valve, a tapered section defining a mixing chamber therein, the tapered section being tapered in a direction toward a spray orifice which is defined through the valve at a terminal point of the tapered section; the valve defining a liquid passageway therethrough connecting the dip tube with the mixing chamber in an open position of the valve, the liquid passageway defining a stem portion, at least a portion of the liquid passageway being disposed in a direction toward the spray orifice and having a longitudinal axis aligned through said portion and said spray orifice, the valve and the liquid passageway being selectively slidable along said longitudinal axis to a closed position wherein the mixing chamber is disconnected from the dip tube, the sprayer body being adapted to cooperate with the retaining rim to fasten the sprayer body to the bottle;

an air passageway, concentrically disposed around said portion of the liquid passageway, the air passageway connecting an interior of the bottle containing said volume of air with the mixing chamber and the air passageway communicating the mixing chamber at a location directly opposite to the tapered section of the sprayer body; wherein the mixing chamber is disconnected from the interior of the bottle in a closed position of the valve whereby the plug seal is configured to seal the stem portion of the liquid passageway and the stem portion is configured to seal the dip tube when the valve is in the closed position; and whereby upon actuation of the squeeze bottle sprayer when the valve is in the open position, a stream of air from the air passageway will be deflected by the tapered section of the sprayer body to converge and impinge upon a core stream of liquid from the liquid passageway in the mixing chamber to atomize the stream of liquid.

10. The squeeze bottle sprayer according to claim 9, wherein the bottle forms an annular groove at the connection of the neck and the bottle; and wherein the sprayer body has a flexible skirt which extends into the annular groove, said annular groove shaped to provide a radially inward force on the flexible skirt.

11. A bottle with a spray dispenser comprising:

a spray housing with a flexible skirt, a first locking rim on the flexible skirt, the spray housing including an integrated valve; and a bottle with a neck, a second locking rim on the neck, an annular groove formed in the bottle at the junction of the neck and the bottle;

wherein the first locking rim and the second locking rim cooperate to fasten the spray housing to the bottle, and the flexible skirt and the annular groove cooperate to provide additional locking force, wherein the annular groove is shaped so that it provides a radially inward force on the flexible skirt.

* * * * *